US010581146B2

(12) United States Patent
Lavin et al.

(10) Patent No.: US 10,581,146 B2
(45) Date of Patent: Mar. 3, 2020

(54) BROADBAND STACKED MULTI-SPIRAL ANTENNA ARRAY

(71) Applicant: THE BOEING COMPANY, Chicago, IL (US)

(72) Inventors: Ronald O'Neil Lavin, Chicago, IL (US); Manny S. Urcia, Wildwood, MO (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/155,703

(22) Filed: Oct. 9, 2018

(65) Prior Publication Data

US 2019/0044222 A1 Feb. 7, 2019

Related U.S. Application Data

(63) Continuation of application No. 15/252,122, filed on Aug. 30, 2016, now Pat. No. 10,096,892.

(51) Int. Cl.
*H01Q 1/36* (2006.01)
*H01Q 1/28* (2006.01)
(Continued)

(52) U.S. Cl.
CPC ..... *H01Q 1/282* (2013.01); *H01Q 1/286* (2013.01); *H01Q 1/36* (2013.01); *H01Q 5/40* (2015.01);
(Continued)

(58) Field of Classification Search
CPC ..... H01Q 1/282; H01Q 1/286; H01Q 1/36; H01Q 5/40; H01Q 5/50; H01Q 9/27; H01Q 21/06
See application file for complete search history.

(56) References Cited

U.S. PATENT DOCUMENTS 2,990,547 A 6/1961 McDougal
3,810,183 A 5/1974 Krutsinger et al.
(Continued)

FOREIGN PATENT DOCUMENTS

CN 101673880 A1 3/2010
CN 101 867 084 A 10/2010
(Continued)

OTHER PUBLICATIONS

Communication pursuant to Article 94(3) EPC dated Jan. 15, 2019 issued by European Patent Office in European Patent Application No. EP17178594.2-1205, 12 pgs.
(Continued)

*Primary Examiner* — Hoang V Nguyen
(74) *Attorney, Agent, or Firm* — Moore Intellectual Property Law, PLLC

(57) ABSTRACT

A broadband stacked multi-spiral antenna array comprising two or more spiral antennas with a dielectric layer having a generally uniform thickness positioned between each pair of stacked antennas, which are all center-fed and in-phase. The antenna array may be embedded in a non-conductive material, such as fiberglass embedded in a resin, a honeycomb core sandwich, or structural foam, that may be used to form a structural element of a mobile platform. The structural element may include a via providing a pathway for coaxial cables. If two structural elements are hatch covers on the port and the starboard sides of an aircraft, the use of a stacked multi-spiral antenna array in each structural element provides two roughly hemispherical coverage patterns which together provide an omni-directional coverage pattern. The stacked multi-spiral antenna array may also include a reflecting cavity placed at the bottom of one of the spiral antennas.

20 Claims, 8 Drawing Sheets

(51) Int. Cl.

| | |
|---|---|
| ***H01Q 9/27*** | (2006.01) |
| ***H01Q 5/40*** | (2015.01) |
| ***H01Q 5/50*** | (2015.01) |
| ***H01Q 21/06*** | (2006.01) |

(52) U.S. Cl.
CPC ..... *H01Q 5/50* (2015.01); *H01Q 9/27* (2013.01); *H01Q 21/06* (2013.01)

(56) References Cited

U.S. PATENT DOCUMENTS

| | | | | |
|---|---|---|---|---|
| 3,823,404 | A | 7/1974 | Buie, Jr. | |
| 4,816,836 | A | 3/1989 | Lalezari | |
| 4,843,403 | A | 6/1989 | Lalezari et al. | |
| 5,153,600 | A | 10/1992 | Metzler et al. | |
| 5,333,002 | A | 7/1994 | Gans et al. | |
| 5,437,091 | A | 8/1995 | Norman | |
| 5,646,633 | A | 7/1997 | Dahlberg | |
| 5,990,849 | A | 11/1999 | Salvail et al. | |
| 6,121,936 | A | 9/2000 | Hemming et al. | |
| 6,166,694 | A | 12/2000 | Ying | |
| 6,198,445 | B1 | 3/2001 | Alt et al. | |
| 6,300,919 | B1 * | 10/2001 | Mehen | H01Q 1/36 343/821 |
| 6,304,232 | B1 | 10/2001 | Brown et al. | |
| 6,407,721 | B1 * | 6/2002 | Mehen | H01Q 1/36 343/700 MS |
| 6,466,177 | B1 | 10/2002 | Kunysz | |
| 7,109,943 | B2 | 9/2006 | McCarville et al. | |
| 7,233,295 | B2 | 6/2007 | Regala | |
| 7,633,451 | B2 | 12/2009 | Robin et al. | |
| 8,395,557 | B2 | 3/2013 | Goins et al. | |
| 8,514,136 | B2 | 8/2013 | McCarthy et al. | |
| 8,791,868 | B2 | 7/2014 | McCarthy et al. | |
| 2004/0070536 | A1 | 4/2004 | Stotler et al. | |
| 2007/0194999 | A1 | 8/2007 | Morton | |
| 2008/0316124 | A1 | 12/2008 | Hook | |
| 2010/0194661 | A1 | 8/2010 | Harokopus et al. | |

FOREIGN PATENT DOCUMENTS

| | | | |
|---|---|---|---|
| EP | 0 416 300 | A2 | 3/1991 |
| EP | 1 261 997 | B1 | 10/2006 |
| EP | 2 065 976 | A1 | 6/2009 |

OTHER PUBLICATIONS

European Search Opinion, European Search Report, 17178594.2-1205, dated Jan. 15, 2018.

You, C. S., et al. : "Design of load-bearing antenna structures by embedding technology of microstrip antenna in composite sandwich structure", Composite Structures, Elsevier Science Ltd, GB, 1 vol. 71, No. 3-4, Dec. 1, 2005 (Dec. 1, 2005 ), pp. 378-382.

H. Schippers, et al., "Integration of Antennas into Composite Load-bearing Aircraft Structures," in Multifunctional Structures/ Integration of Sensors and Antennas (Meeting Proceedings RTO-MP-AVT-141 ), 2006, pp. 1-18.

Harmen Schippers, et al., "Towards Structural Integration of Airborne Ku-band SatCom Antenna," Antennas and Propagation (EuCap), 2013 European Conference on, Gothenburg, pp. 2963-2967.

Israel Hinostroza et al, "Two Stacked Orttwgonally Wound Spirals wiH1 Connected Arms," 2015 IEEE International Symposium on Antennas and Propagation & USNC/URSI National Radio Science Meeting, Vancouver, BC, 2015, pp. 1976-1977.

Communication pursuant to Article 94(3) EPC dated Oct. 7, 2019 in the corresponding EP Application No. 17178594.2, 11 pgs.

* cited by examiner

BROADBAND STACKED MULTI-SPIRAL ANTENNA ARRAY

CROSS-REFERENCE TO RELATED APPLICATIONS

The present application is a continuation application of and claims priority to U.S. patent application Ser. No. 15/252,122 entitled "BROADBAND STACKED MULTI-SPIRAL ANTENNA ARRAY INTEGRATED INTO AN AIRCRAFT STRUCTURAL ELEMENT," filed on Aug. 30, 2016, the contents of which are expressly incorporated herein by reference in their entirety.

BACKGROUND

Field

The present disclosure is generally related to antenna systems and more particularly, to a conformal broadband stacked multi-spiral antenna system configured for integration into a structural element of a mobile platform.

Related Art

Present day mobile platforms, such as aircraft (manned and unmanned, fixed-wing and rotary-wing), spacecraft, watercraft, and even land vehicles, often require the use of multiple antenna systems for transmitting and receiving electromagnetic signals. These signals include radar transmissions, signals intelligence (SIGINT) communications, Communication, Navigation, and Identification (CNI) signals, electromagnetic counter measures (ECM) and electronic warfare (EW) signals, and other sensor-processing applications. Each of these applications requires its own antenna system for the radiation and receipt of signals, and therefore many of these mobile platforms may have severe antenna crowding problems.

Conventional antennas may form protuberances that detract from the aerodynamics of the mobile platform. Also, if an antenna protrudes from the mobile platform body, the antenna may be exposed to accidental damage from ground personnel, environmental effects, or airborne objects. Typically weight is added to the mobile platform by the various components on which the antenna array is mounted. These components may include metallic gimbals, support structures, or other like substructures that add "parasitic" weight that is associated with the antenna array, but otherwise perform no function other than as a support structure for a portion of the antenna array. By the term "parasitic" it is meant weight that is associated with components of the support structure or antenna feed components that are not directly necessary for transmitting or receiving operations of the antenna array.

In the case of helicopters, finding an available area on the outside of a helicopter body to mount an antenna where the antenna will not interfere with a rotor, a stabilizer, or control surfaces of the helicopter can be difficult. There may be little available area on the helicopter body to mount such an antenna where the antenna can provide unobstructed coverage in all directions around the helicopter. For example, mounting a "towel bar" type antenna on a tail boom section of a helicopter makes use of available, largely unused space on the helicopter. However, towel bar type antennas extend outward from the tail boom section and may be subject to environmental damage, or damage by personnel servicing the helicopter when the helicopter is not in flight.

Therefore, there is a need for improving the design of antenna systems as well as their placement on mobile platforms to overcome the problems arising from the lack of space available for the various required antenna systems and also to avoid interference issues.

SUMMARY

A broadband stacked multi-spiral antenna array for use in a mobile platform is described, wherein the multi-spiral antenna array comprises two or more stacked spiral antennas. The stacked spiral antennas may be Archimedean spiral antennas, equiangular spiral antennas, sinuous spiral antennas, or slotted spiral antennas, where the stacked antennas are of the same type, e.g., Archimedean or equiangular, but may not be identical in terms of the outer diameters of each spiral antenna. Generally, these spiral antennas are all concentric and aligned, with arms of the same number, width, spacing, and turn rate.

All spiral antennas in the broadband stacked multi-spiral antenna array are center-fed and fed in-phase, which may be by coaxial cables connecting a mobile platform's corresponding transceiver to the outermost spiral antenna and then passing to each of the adjacent innermost spiral antenna(s). Other forms of connecting transmission lines include microstrip lines with planar baluns and striplines. There may be two or more arms on each of the stacked spiral antennas and each of the arms may include terminations such as resistors, meander lines, or capacitors, or no terminations at all.

The stacked multi-arm spiral antenna arrays comprise a low dielectric layer that is placed between each pair of stacked spiral antennas, where the low dielectric layer may be air, vacuum, or a non-conductive low dielectric laminate, such as the glass reinforced hydrocarbon/ceramic laminate RO4003® or a fiberglass fabric embedded in an epoxy resin, e.g. FR-4. This low dielectric layer provides an improved impedance match between each pair of stacked spiral antennas by acting as a variable capacitor that electrically couples the two spiral antennas, with the upper spiral antenna in the stack being excited by both its feed and the lower spiral antenna(s). By introducing capacitance between the stacked spiral antennas, the input impedance of the broadband stacked multi-spiral antenna array is changed, i.e., reduced, such that its impedance more closely matches the impedance of the transmission (or feed) lines to the stacked spiral antennas.

Each stacked spiral antenna in a broadband stacked multi-spiral antenna array is center-fed, by electrically connecting transmission lines to the ends of each arm of a stacked spiral antenna at the center of the broadband stacked multi-spiral antenna array. Thus the same radio frequency (RF) signal is divided and sent to each stacked spiral antenna in the broadband stacked multi-spiral antenna array at its center. Each RF signal is also in-phase because the low dielectric layer is thin enough so that there is no RF dielectric propagation through the low dielectric layer that affects the RF performance of the broadband stacked multi-spiral antenna array, i.e., the divided RF signals essentially reach each stacked spiral antenna simultaneously. For example, the uniform thickness of the low dielectric layer may be less than 10.0% of the wavelength of a center-operating frequency ($\lambda co$) of the broadband stacked multi-spiral antenna array.

A stacked multi-spiral antenna array formed in this manner may be integrated into a load-bearing or non-load-bearing structural element of a mobile platform, such as a composite cover, door, or panel constructed using non-conductive face sheets and a foam or other lightweight, non-conductive core, such as a honeycomb sandwich core or a structural foam, which may be framed with conductive materials, where the cover, door, or panel is attached to a host such as a helicopter (or other mobile platform).

In one embodiment of a dual-spiral antenna array, two thin, flexible foil antenna elements may be bonded to the inner and outer mold lines of the host non-conductive cover, door, or panel structural element, and each foil antenna element may be covered with a non-conductive, protective coating, with feed wires soldered to the centers of the antennas before coating and brought through vias or small holes in the structural element.

In another embodiment, these two thin, flexible foil antenna elements may be formed by etching copper onto a low dielectric substrate (for example, a polyimide film), which may be co-cured into the cover, door, or panel composite laminate, with feed wires for each spiral antenna soldered together before co-curing, and with the resulting pair of feed wires protruding through the composite laminate such that both foil antenna elements are connected at their arms at the center of the foil antenna elements, and the feed wires are left protruding through the composite laminate, through vias in the structural element. In general, co-curing refers to the process of curing a composite laminate and simultaneously bonding it to some other uncured material, with all resins and adhesives being cured during the same process.

In yet another embodiment, the antenna elements of the stacked multi-spiral antenna array are first bonded while separated by a low dielectric layer, the centers of the stacked spiral antennas are soldered together using vias and solder, and then bonded as a completed laminate to the outer or inner face of a non-load-bearing structural element as an appliqué, with feed wires left protruding through vias in the completed laminate and the non-load bearing structural element.

In yet another embodiment, a stacked multi-spiral antenna array comprises any number N of stacked spiral antennas, which are all center-fed and in-phase. Between each pair of stacked spiral antennas, there is placed a low dielectric layer, there being N−1 dielectric layers in all in the stacked N-spiral antenna array. Each of the N spiral antennas may have a different diameter, with largest diameter antenna being placed at the outside or upper antenna of the stacked spiral antenna array, with each adjacent inside or lower spiral antenna having a lesser diameter. The spiral antennas of a stacked spiral antenna array are all concentric and aligned. Generally, the innermost spiral antenna may have one turn, each additional adjacent spiral antenna will add a turn, with the outermost spiral antenna having N turns. However, the number of turns of each spiral antenna may also be refined, and in an embodiment comprising two stacked dual-arm spiral antennas, this stacked dual-arm dual-spiral antenna array may comprise two approximately identical spirals, which may be identical in number of the turns, width, and space between the arms, and outside diameters of each of the dual-arm spiral antennas.

Other devices, apparatus, systems, methods, features and advantages will be or will become apparent to one with skill in the art upon examination of the following figures and detailed description. It is intended that all such additional systems, methods, features and advantages be included within this description, be within the scope of, and be protected by the accompanying claims.

BRIEF DESCRIPTION OF THE FIGURES

The components in the figures are not necessarily to scale. In the figures, like reference numerals designate corresponding parts throughout the different views, and elements may not be shown to scale.

DETAILED DESCRIPTION

A broadband stacked multi-spiral antenna array for use in a mobile platform is described, wherein the stacked multi-spiral antenna array comprises two or more stacked spiral antennas. The two or more stacked spiral antennas may include two or more Archimedean spiral antennas, two or more equiangular spiral antennas, two or more sinuous spiral antennas, or two or more slotted spiral antennas, where the two or more stacked spiral antennas are identical as to type in each stack. All spiral antennas in the stack are center-fed by feed lines and fed in-phase, which may be implemented by feed lines comprising coaxial cables electrically connecting the corresponding transceiver to arms of the outermost or innermost spiral antenna and then passing to the arms of each of the other spiral antenna(s) in the stack at their respective centers. The spiral antennas may also be electrically connected to the corresponding transceiver by microstrip lines or striplines that electrically connect to the arms at the center of the spiral antennas. The spiral antennas in a stack may all be concentric and aligned, with arms of the same number, width, spacing, and turn rate. The outside diameters of the spiral antennas may vary.

The stacked multi-spiral antenna array also comprises a low dielectric layer that is placed between each pair of stacked spiral antennas, wherein pair(s) of stacked spiral antennas with a low dielectric layer interposed in the stack may be embedded into a non-conductive composite laminate, which composite laminate may contain, for example, one or more plies of a laminate such as a fiberglass fabric in an epoxy resin. A stacked multi-spiral antenna array formed in this matter may then be integrated into a non-load bearing structural element of a mobile platform, such as a cover, door, or access panel of a helicopter (or other mobile platform). It may also be integrated into a load-bearing stacked composite/metal structural element, such as an aircraft fuselage, wing, or empennage.

Figure 1:
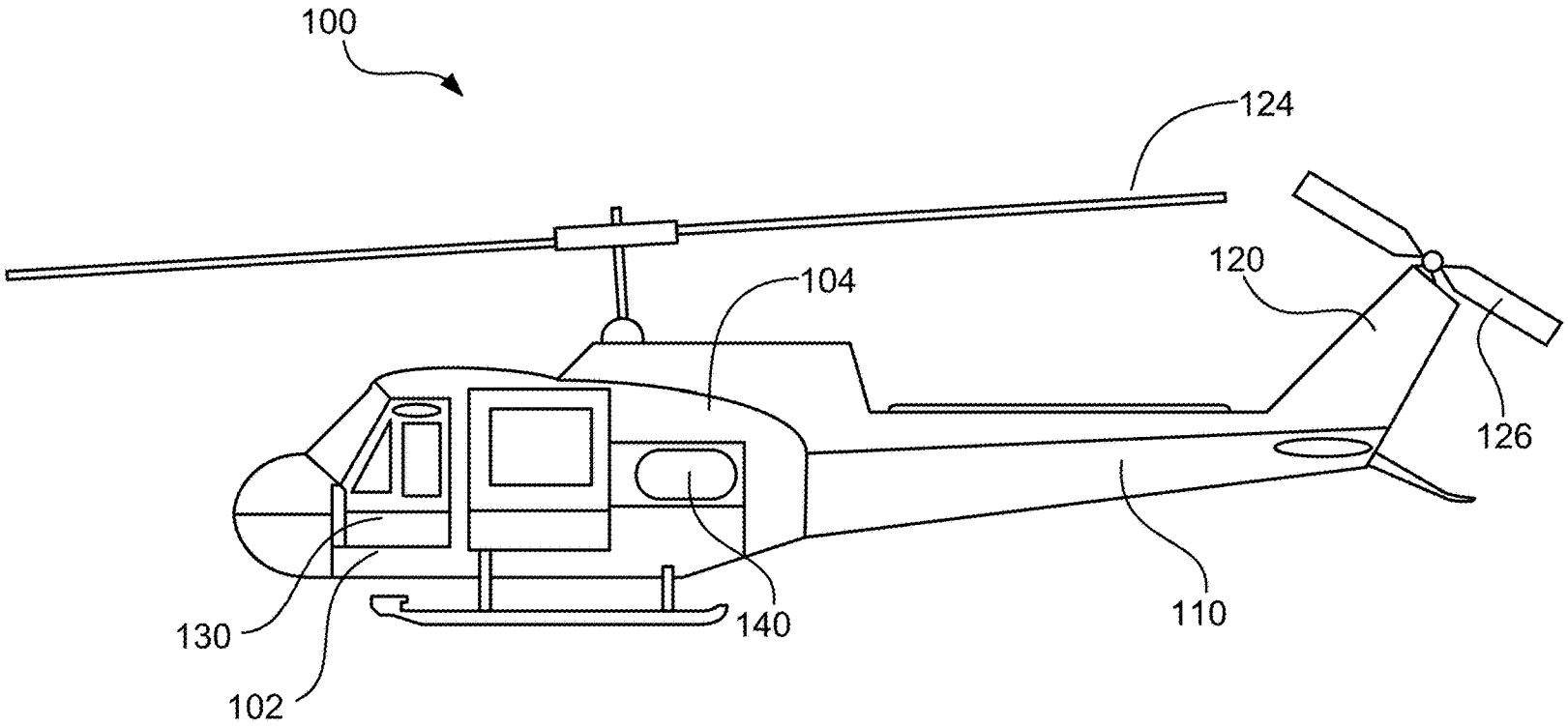
FIG. 1 is a side view of an exemplary helicopter equipped with non-load bearing structural elements comprising stowage and avionics bay access doors located on outer surfaces of sections of the fuselage of the helicopter.

FIG. 1 is a side view of an example of a helicopter equipped with several non-load bearing structural elements such as stowage and avionics bay access doors that may be located on an outer surface of sections of the fuselage of the helicopter, where the access doors include a conformal broadband stacked multi-spiral antenna assembly in accordance with the present disclosure. In FIG. 1, an example aircraft such as a helicopter 100 includes a front fuselage 102 and a main fuselage 104, with a tail boom section 110. Inside the tail boom section 110, a driveshaft and associated linkages (not shown) extend from a main engine (not shown) that drives a main rotor 124. A tail boom support (not shown) within the tail boom section 110 physically supports a tail section 120 having a tail rotor 126.

Also shown in FIG. 1 are a port-side forward avionics bay access door 130 and port-side aft stowage bay access door 140. On the starboard side of helicopter 100, there may be a corresponding starboard-side forward avionics bay access door (not shown) and a starboard-side aft stowage bay access door (not shown), respectively. If there are access doors on both the port-side and the starboard-side (or top and bottom) of the helicopter 100 that are mirror images of each other, then a broadband stacked multi-spiral antenna array with a reflecting cavity in accordance with the present disclosure may be embedded in each access door. These antenna arrays will then each provide a roughly semi-hemispherical coverage pattern, which taken together will approximate a pseudo-omni-directional coverage pattern antenna for the helicopter 100.

Figure 2:
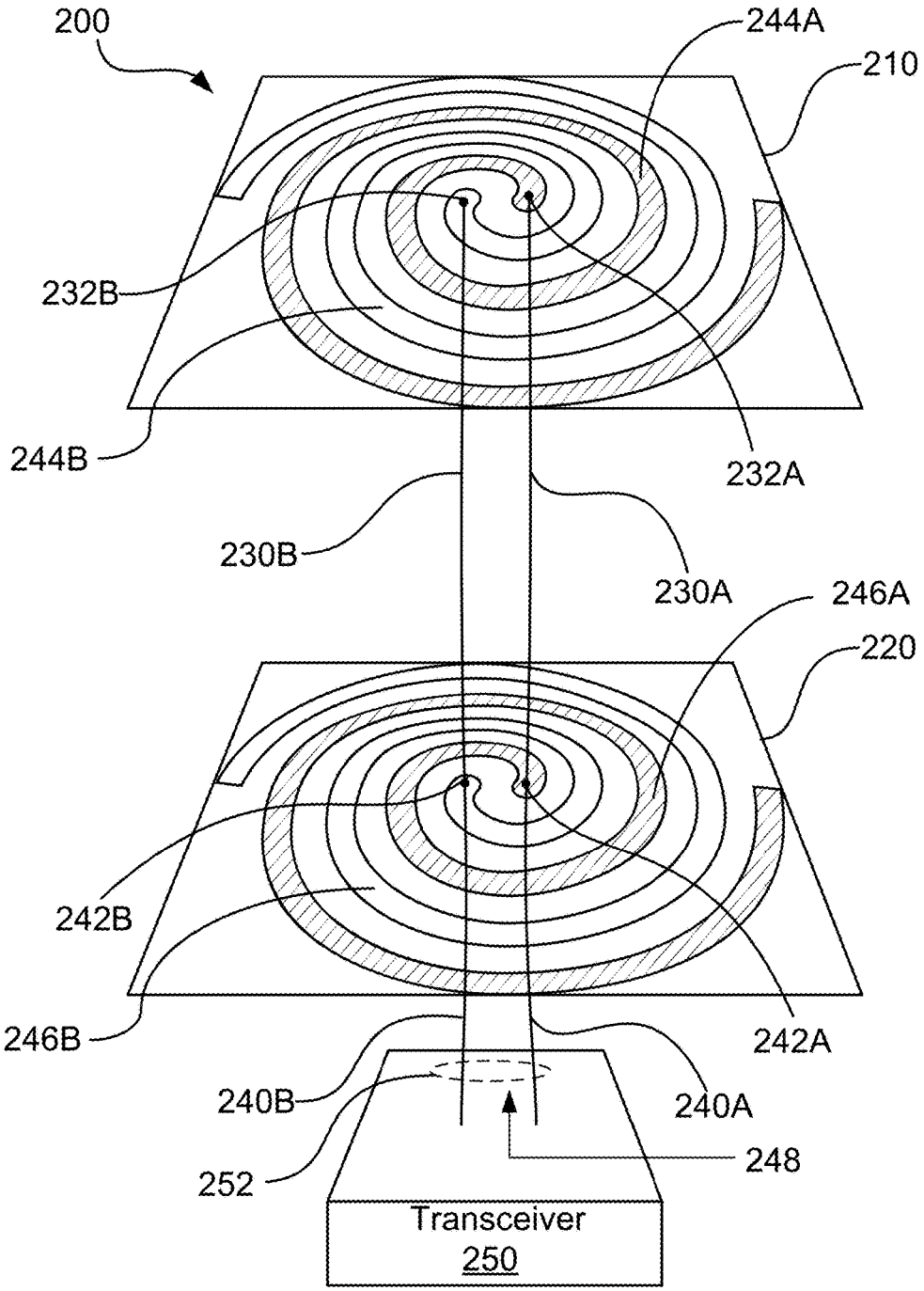
FIG. 2 is schematic diagram of an example of an implementation of a broadband stacked dual-spiral antenna array in accordance with the present disclosure illustrating its electrical connection to a transceiver of a mobile platform.

Turning to FIG. 2, a schematic diagram of a broadband stacked broadband stacked multi-spiral antenna array 200 in accordance with the present disclosure illustrating its electrical connection to a transceiver 250 of a mobile platform is shown. In this example the broadband stacked multi-spiral antenna array is shown as a broadband dual-spiral antenna array. In FIG. 2, dual-arm spiral antennas 210 and 220 are two dual-arm Archimedean spiral antennas, each with four turns and equal width and spacing, where the dual-arm spiral antenna 220 is electrically connected to transceiver 250 by coaxial cables 240A and 240B. It is appreciated by those of ordinary skill in the art that the dual-arm spiral antennas 210 and 220 may be two Archimedean spiral antennas, two equiangular spiral antennas, two sinuous spiral antennas, or two slotted spiral antennas. Coaxial cable 240A may be directly connected to the end 242A of one arm at the center of the dual-arm spiral antenna 220, and coaxial cable 240B may be directly connected to the end 242B of the other arm at the center of dual-arm spiral antenna 220. These connections may be made by soldering coaxial cables 240A and 240B to the ends 242A, 242B, respectively, of the arms of dual-arm spiral antenna 220. It is also appreciated by those of ordinary skill in the art that the coaxial cables 240A and 240B are an example of transmission lines utilized as feed lines of both the dual-arm spiral antennas 210 and 220, however, other types of transmission lines may also be utilized based on the design of the dual-arm spiral antennas 210 and 220. For example, the feed lines may be instead microstrip lines or striplines.

Coaxial cables 230A and 230B directly electrically connect the two arms of dual-arm spiral antenna 220 to the ends 232A, 232B, respectively, of two arms of dual-arm spiral antenna 210. Likewise, these electrical connections may be made by soldering the ends of coaxial cables 230A and 230B to the end 232A of one arm at the center of dual-arm spiral antenna 210 and to the end 232B of the other arm at the center of the dual-arm spiral antenna 210, respectively. The ends of the arms opposite the centers of the dual-arm spiral antennas 210 and 220 are unconnected electrically, but may have terminations (not shown), such as resistors, meander lines, or capacitors. As such, the dual-arm spiral antennas 210 and 220 are center-fed by feed lines that are the coaxial cables 230A and 230B. Additionally, both of the dual-arm spiral antennas 210 and 220 are in-phase because the electrical distance of the coaxial cables 230A and 230B between 232A and 242A and 232B and 242B are short in electrical distance and, therefore, do not introduce any phase difference between 232A and 242A and 232B. The electrical distances are short because (as discussed later) the distance between the two dual-arm spiral antennas 210 and 220 is approximately less than 10% of the operating wavelength of the broadband stacked broadband stacked multi-spiral antenna array 200.

In this example, the broadband stacked dual-spiral antenna array 200 may also include a low dielectric layer (not shown) interposed between dual-arm spiral antennas 210 and 220. The low dielectric layer may have a generally uniform thickness of less than approximately 10.0% of $\lambda co$, where $\lambda co$ is a wavelength of a center-operating frequency of the broadband stacked dual-spiral antenna array 200. The low dielectric layer (not shown) may be air, vacuum, or a non-conductive low dielectric laminate, such as a fiberglass fabric embedded in an epoxy resin. If the low dielectric layer is a laminate, it may include one or more vias through which coaxial cables 230A and 230B pass through between dual-arm spiral antennas 210 and 220.

It is appreciated by those of ordinary skill in the art that the dielectric layer may or may not be present between the dual-arm spiral antennas 210 and 220 because the dielectric is acting as a spacer (e.g., the spacer has a spacer distance equal to the uniform thickness of the low dielectric layer) between the two dual-arm spiral antennas 210 and 220 in a way that does not introduce any RF interactions between the first and second dual-arm spiral antennas 210 and 220. However, in this example, the dielectric layer does act to insulate the conductive arms 244A and 244B of the first dual-arm spiral antenna 210 from the conductive arms 246A and 246B of the second dual-arm spiral antenna 220. In this example, the conductive arms 244A, 244B, 246A, and 246B of the first and second dual-arm spiral antennas 210 and 220 act as a parallel-plate capacitor where the capacitance created by placing the conductive arms 244A, 244B, 246A, and 246B of the first and second dual-arm spiral antennas 210 and 220 close to each other is directly proportional to the surface area of the conductive arms 244A, 244B, 246A, and 246B and inversely proportional to the separation distance between the conductive arms 244A, 244B, 246A, and 246B (i.e., the spacer distance). This capacitance created by placing the first and second dual-arm spiral antennas 210 and 220 close together is added to the parasitic capacitance between the conductive arms 244A, 244B, 246A, and 246B of the broadband stacked multi-spiral antenna array 200 in a way that changes the reactance of the system and tunes and matches the input impedance 248 of the broadband stacked multi-spiral antenna array 200 looking into an input node 252 of the broadband stacked multi-spiral antenna array 200 to the characteristic impedance of the input transmission line that includes the coaxial cables 240A and 240B and is connected to the transceiver 250.

Figure 3A:
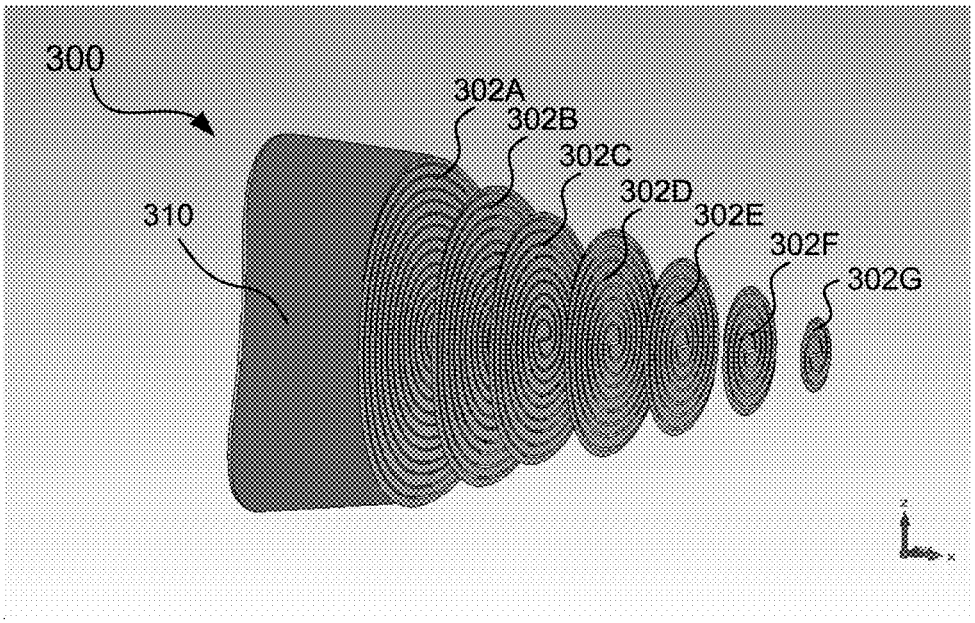
FIG. 3A is schematic exploded diagram of an example of an implementation of a broadband stacked multi-spiral antenna array in accordance with the present disclosure illustrating the stacking of seven spiral antennas.

FIG. 3A is schematic exploded diagram of an example of an implementation of a broadband stacked multi-spiral antenna array in accordance with the present disclosure illustrating seven stacked spiral antennas 302A, 302B, 302C, 302D, 302E, 302F, and 302G. It is appreciated by those of ordinary skill in the art that the seven stacked spiral antennas 302A, 302B, 302C, 302D, 302E, 302F, and 302G may be optionally seven stacked Archimedean spiral antennas, seven stacked equiangular spiral antennas, seven stacked sinuous spiral antennas, or seven stacked slotted spiral antennas. Similar to the example shown in FIG. 2, all seven stacked spiral antennas are center-fed and fed in-phase because each stacked spiral antenna is feed with transmission lines (e.g. a coaxial lines) at the center of the of each stacked spiral antenna similar to the examples shown in FIG. 2 and the electrical distance of the coaxial cables are short in electrical distance and, therefore, do not introduce any phase difference between any of the seven stacked spiral antennas. Antenna 302G may be electrically connected to transmitters, receivers, or transceivers of a mobile platform using coaxial cables (not shown). A series of coaxial cables (not shown) may the connect spiral antennas 302A, 302B, 302C, 302D, 302E, and 302F to each other in series, with spiral antenna 302F connected to spiral antenna 302G. In this example, spiral antenna 302A is affixed to substrate 310.

The broadband stacked multi-spiral antenna array 300 also includes multiple low dielectric layers (not shown) interposed between each pair of adjacent stacked spiral antennas comprising stacked spiral antennas 302A and 302B, stacked spiral antennas 302B and 302C, stacked spiral antennas 302C and 302D, stacked spiral antennas 302D and 302E, stacked spiral antennas 302E and 302F, and stacked spiral antennas 302F and 302G. As such, the seven stacked spiral antennas have three pairs of adjacent stacked spiral antennas. These low dielectric layers may have a generally uniform thickness of less than approximately 10.0% of λco, where λco is a center-operating wavelength of a center-operating frequency of the broadband stacked multi-spiral antenna array 300.

It is noted that in this example, each individual stacked spiral antenna 302A, 302B, 302C, 302D, 302E, 302F, and 302G is similar in configuration and layout to the example of the dual-arm spiral antennas 210 and 220 shown in FIG. 2. The relative radius (and corresponding diameter and circumference) of each individual stacked spiral antenna 302A, 302B, 302C, 302D, 302E, 302F, and 302G are shown as being different but each individual stacked spiral antenna 302A, 302B, 302C, 302D, 302E, 302F, and 302G has two arms (i.e., dual-arm) having an arm width for each arm, a number of turns for each arm, and a spacing between the arms. In this example, the number of turns, arm width, and spacing between arms are the same for all the stacked spiral antennas 302A, 302B, 302C, 302D, 302E, 302F, and 302G.

In this example of an implementation, the low dielectric layer may be a fiberglass fabric embedded in an epoxy resin that has a uniform thickness of approximately $1/100^{th}$ of λco. The operating frequency range of the broadband stacked multi-spiral antenna array 300 may be approximately 0.225 gigahertz (GHz) to approximately 2.0 GHz with a center-operating frequency equal to approximately 1.112 GHz with a corresponding λco equal to approximately 266.48 cm. The low dielectric layer may also include one or more vias through which transmission lines, such as coaxial cables (not shown), pass through to provide a feed line that electrically connects each of the stacked spiral antennas 302A, 302B, 302C, 302D, 302E, 302F, and 302G.

In this example, the stacked spiral antenna 302A is the outermost spiral antenna of the broadband stacked multi-spiral antenna array 300 and has the largest outside diameter of the seven stacked spiral antennas 302A-302G. Each adjacent stacked spiral antenna, commencing with stacked spiral antenna 302B, has a smaller outside diameter, with stacked spiral antenna 302G having the smallest outside diameter of the seven stacked spiral antennas.

Figure 3B:
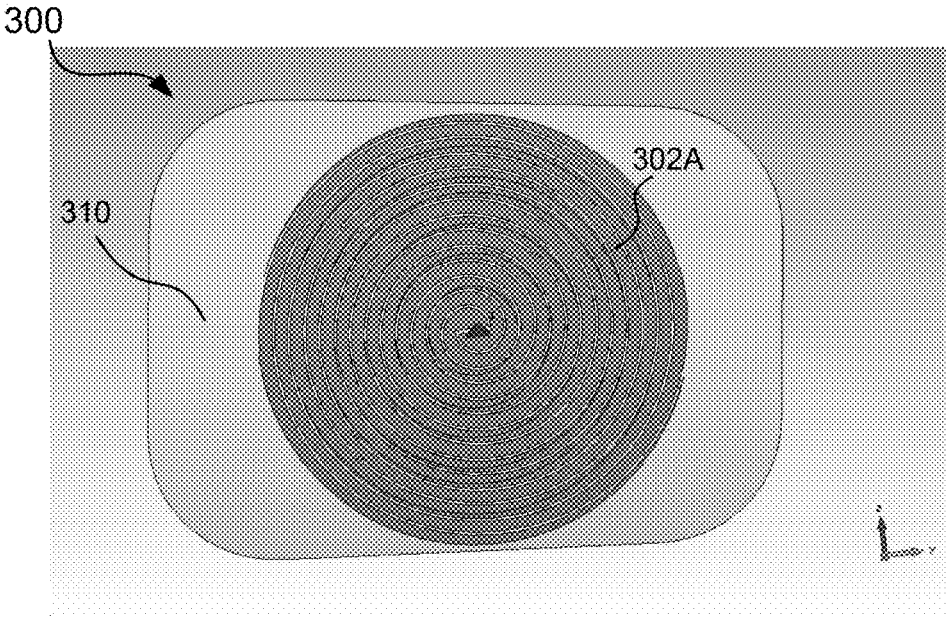
FIG. 3B is a top view of the stacked multi-spiral antenna array shown in FIG. 3A.

FIG. 3B is a top view of the stacked multi-spiral antenna array shown in FIG. 3A, showing spiral antenna 302A affixed to substrate 310.

Figure 4A:
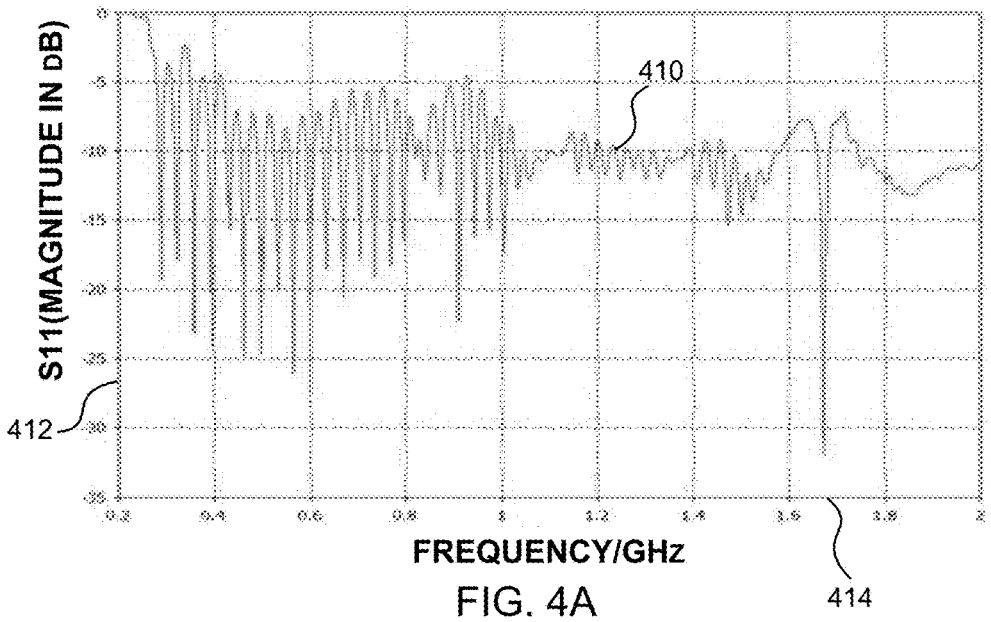
FIG. 4A shows a graph of a reflection coefficient ($|S_{11}|$) as a function of frequency for single spiral antenna array.

FIG. 4A shows a graph of a reflection coefficient ($|S_{11}|$) as a function of frequency for a single spiral antenna. For a transmitter or receiver to deliver, or receive, power to, or from, an antenna, the impedance of the transmitter or receiver and its corresponding transmission line must be well matched to the input impedance of the antenna array. The Voltage Standing Wave Ratio (VSWR) is a parameter that numerically measures how these impedances match. For example, a transmission line may be a 50-ohm feed cable matched with an antenna array that has a 100-ohm feed point input impedance.

VSWR is defined by the formula:

$$VSWR = \frac{1+\Gamma}{1-\Gamma},$$

where Γ (gamma) is the reflection coefficient (also known as $|S_{11}|$ when utilizing scattering parameters which are directly related to return loss). The closer that the VSWR value is to 1.0, the better the match between the antenna and the transmission, where a minimum perfect match has a VSWR equal to 1.0, which means that all the power from the transmission line is being delivered to the antenna without any mismatch reflections. Conversely, reflected power $|S_{11}|$ may be measured as a percentage of the power reflected, or in decibels (dB) the higher the negative number, the better the match. For example, a VSWR of 4.0 equates to a Γ of 0.333 and a reflected power of −9.55 dB, and a VSWR of 2.0 equates to a Γ of 0.600 and a reflected power of −4.44.

Returning to FIG. 4A, the plot 410 of the magnitude of the reflection coefficient ($|S_{11}|$) as a function of frequency for a single spiral antenna is shown, where the y-axis 412 of plot 410 represents $|S_{11}|$ in decibels and the x-axis 414 represents frequency with range of 0.2 GHz to 2.0 GHz. The plot 410 of FIG. 4A for a single spiral antenna may be used as a standard by which to show the improvement in matching impedance of multi-spiral antenna arrays in accordance with the present disclosure.

Figure 4B:
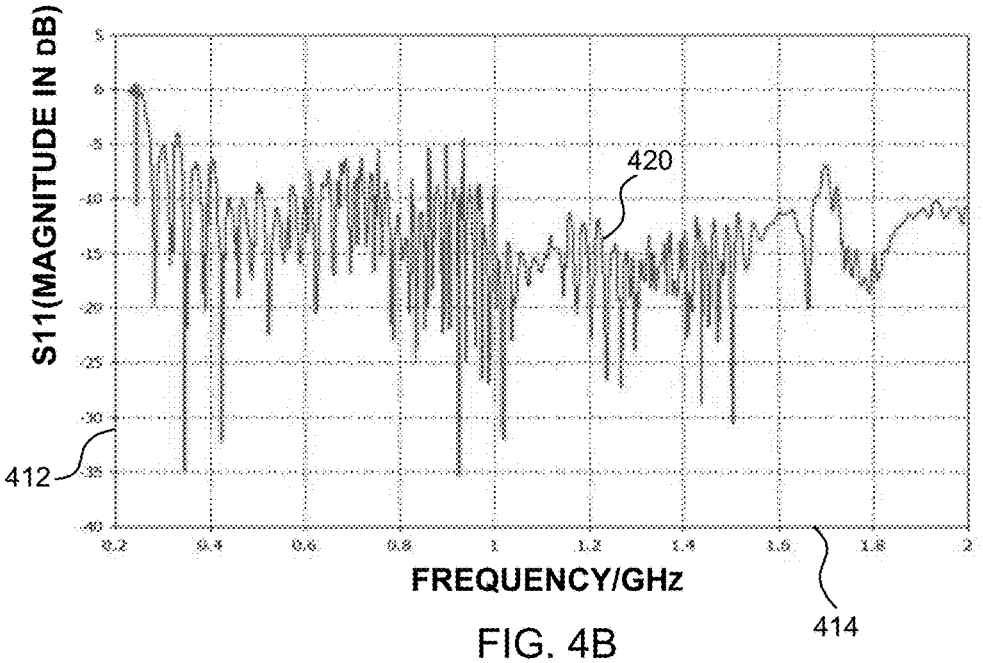
FIG. 4B shows a graph of a reflection coefficient ($|S_{11}|$) as a function of frequency for a dual-spiral antenna array in accordance with the present disclosure

Turning to FIG. 4B, a plot 420 of the magnitude of the reflection coefficient ($|S_{11}|$) as a function of frequency for a dual-spiral antenna array in accordance with the present disclosure is shown. Comparing plot 420 to plot 410 of FIG. 4A, plot 410, in general, shows a reflection coefficient of roughly −10 dB throughout the broadband frequency range of 0.2 GHz to 2.0 GHz. Looking at plot 420 of FIG. 4B, a reflection coefficient of roughly −15 dB throughout the broadband frequency range of 0.2 GHz to 2.0 GHz is shown, which is an improvement of approximately −5 dB over of plot 410 of FIG. 4A. Moreover, at the low end of the band, i.e., about 100 MHz, there is also improved impedance match.

Figure 4C:
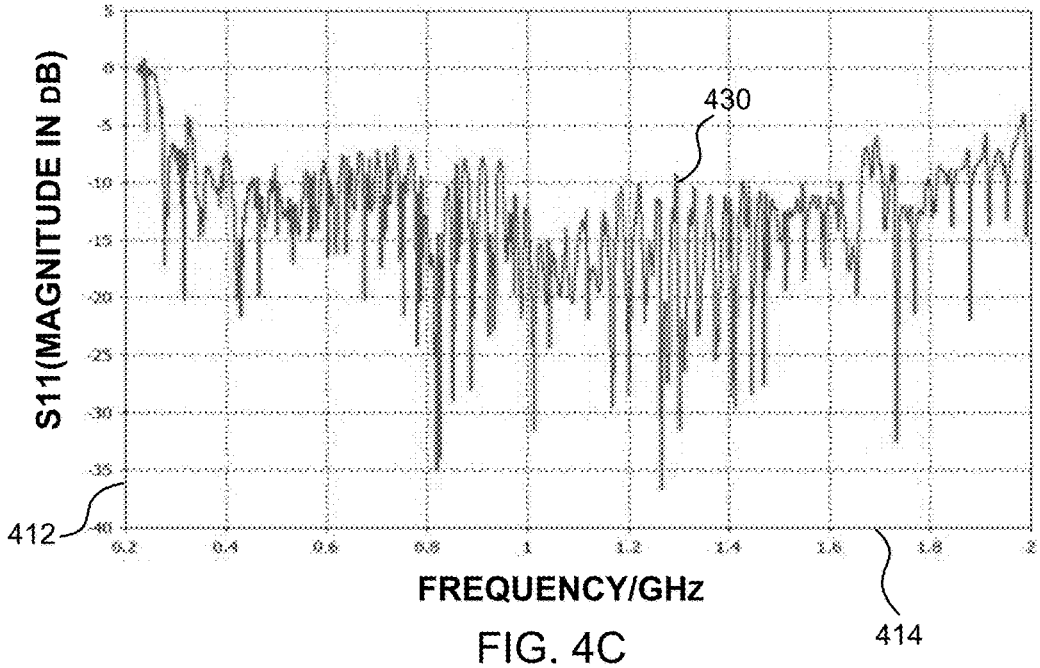
FIG. 4C shows a graph of a reflection coefficient ($|S_{11}|$) as a function of frequency for a triple-spiral antenna array in accordance with the present disclosure.

FIG. 4C shows a graph of a reflection coefficient ($|S_{11}|$) as a function of frequency for a triple-spiral antenna array in accordance with the present disclosure. Looking at plot 430 of FIG. 4C, throughout the broadband frequency range of approximately 0.8 GHz to 1.6 GHz, the reflection coefficient varies between roughly −10 dB and −25 dB, which also represents an improvement over plot 410 of FIG. 4A.

Figure 4D:
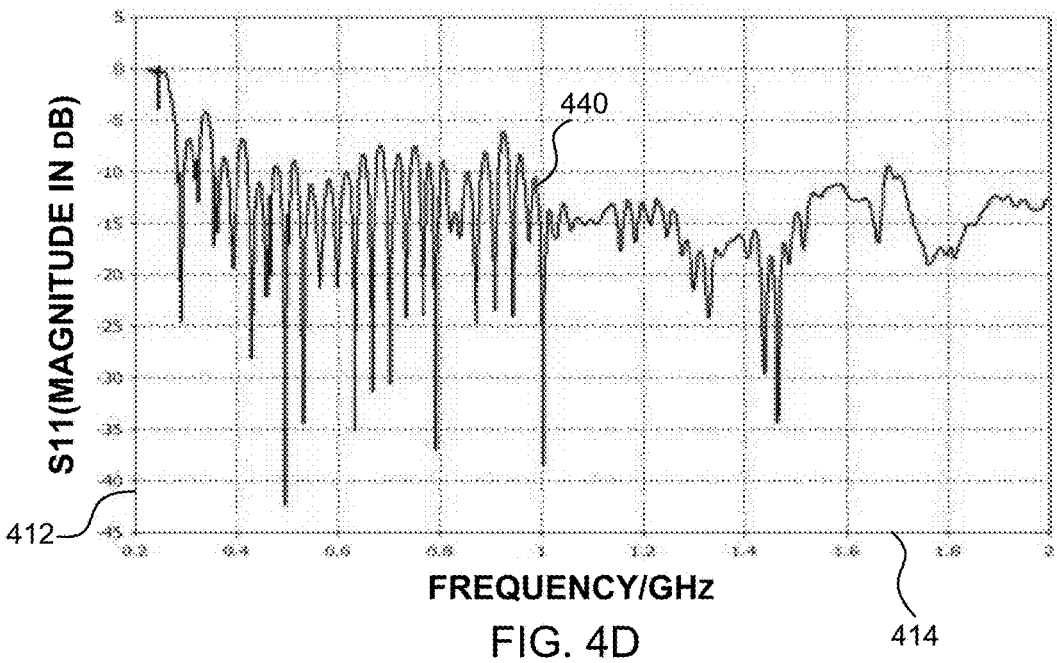
FIG. 4D shows a graph of a reflection coefficient ($|S_{11}|$) as a function of frequency for multi-spiral antenna array comprising seven stacked spiral antennas in accordance with the present disclosure.

FIG. 4D shows a plot 440 of a reflection coefficient ($|S_{11}|$) as a function of frequency for a multi-spiral antenna array comprising seven stacked spiral antennas in accordance with the present disclosure. Comparing plot 440 to plot 410 of FIG. 4A, plot 440, in general, shows a reflection coefficient of roughly −15 or below dB throughout the broadband frequency range of 1.0 GHz to 2.0 GHz, and between −10 dB and 15 dB below 1.0 GHz.

Figure 5:
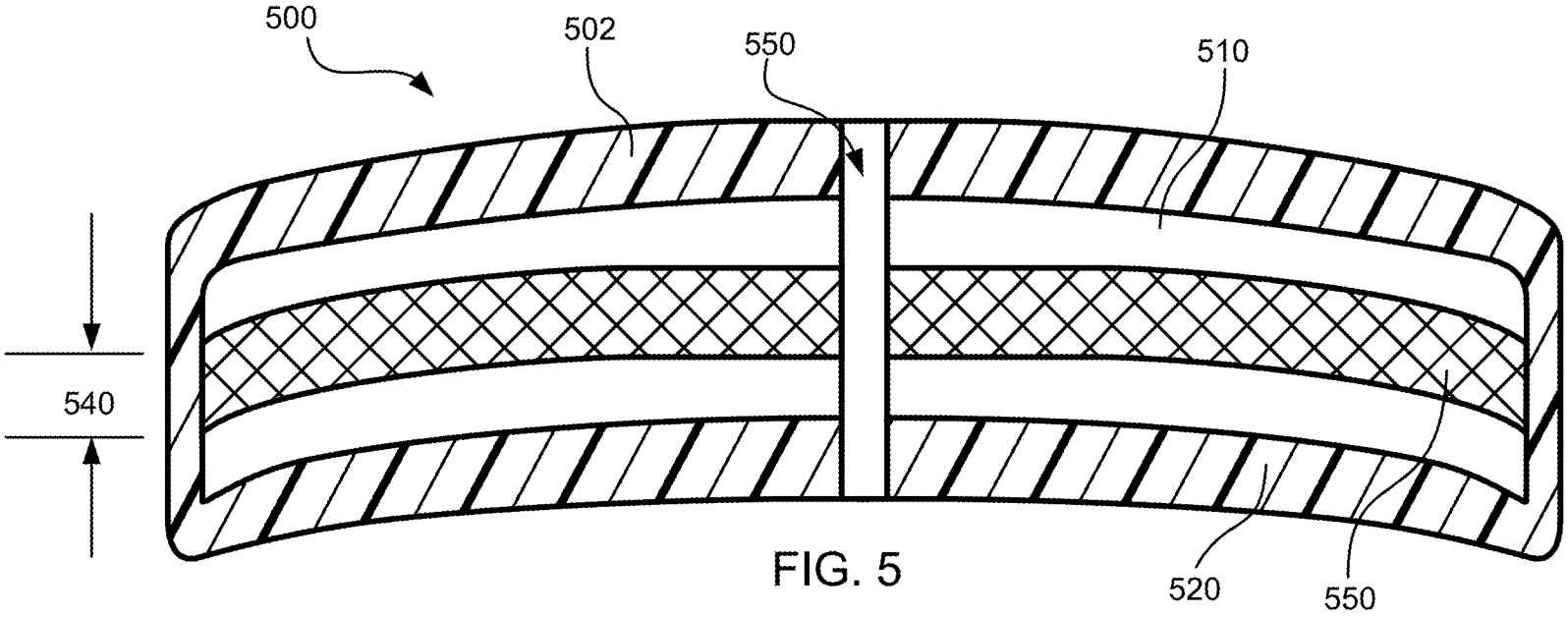
FIG. 5 is section longitudinal side view of another example of an implementation of a broadband stacked dual-spiral antenna array in accordance with the present disclosure shown embedded in a non-load-bearing structural element of a mobile platform, taken at a mid-point of the stacked broadband dual-spiral antenna array.

In FIG. 5, a section longitudinal side view of a conformal integrated broadband stacked multi-spiral antenna system 500, in accordance with the present disclosure taken at a mid-point of the broadband stacked multi-spiral antenna array, is shown. The conformal integrated broadband stacked multi-spiral antenna system 500 includes a first dual-arm spiral antenna 510 and a second dual-arm spiral antenna 520 with a low dielectric layer 530 with a generally uniform thickness interposed between the two dual-arm spiral antennas 510 and 520. The thickness 540 of the low dielectric layer 530 may have a thickness of less than approximately 10.0% of the λco, where λco is a wavelength of a center-operating frequency mid-way between the highest operating frequency and the lowest operating frequency of the broadband stacked multi-spiral antenna array. For example, the thickness 540 may be $1/100^{th}$ the λco.

The first dual-arm spiral antenna 510, the second dual-arm spiral antenna 520, and the low dielectric layer 530 are shown embedded in a composite laminate 502 to form the conformal integrated broadband stacked multi-spiral antenna system 500. The composite laminate 502 may include one or more plies of the composite laminate, which generally includes a fibrous material embedded in a resinous matrix. Examples of the fibrous material include fiberglass, KEVLAR®, carbon fiber, and a carbon KEVLAR® hybrid fabric, all of which may be used with any of an epoxy resin, a vinyl ester resin, or a polyester resin. The conformal integrated broadband stacked multi-spiral antenna assembly 500 may be formed by co-curing, i.e., curing the composite laminate 502 while at the same time bonding it to the stacked dual-arm spiral antennas 510 and 520 and the low dielectric layer 530, and curing as well any resins and adhesives used in the system. In this example, the composite laminate 502 may be described as having a first surface 560 and a second surface 565. The first surface 560 may be referred to as an "outer-surface" of the composite laminate 502 while the second surface 565 may be referred to as an "inner-surface" of the composite laminate 502.

As discussed previously with regard to FIG. 2, it is appreciated by those of ordinary skill in the art that the low dielectric layer 530 may or may not be present between the dual-arm spiral antennas 510 and 520 because the low dielectric layer 530 is acting as a spacer (i.e., the thickness 540 is a spacer distance) between the dual-arm spiral antennas 510 and 520 in a way that does not introduce any RF interactions between the first and second dual-arm spiral antennas 510 and 520 but instead acts to insulate the conductive arms (shown as 244A and 244B in FIG. 2) of the first dual-arm spiral antenna 510 from the conductive arms (shown as 246A and 246B in FIG. 2) of the second dual-arm spiral antenna 520. In this example, the conductive arms of the first and second dual-arm spiral antennas 510 and 520 act as a parallel-plate capacitor where the capacitance created by placing the conductive arms of the first and second dual-arm spiral antennas 510 and 520 close to each other is directly proportional to the surface area of the conductive arms and inversely proportional to the separation distance between the conductive arms (i.e., the spacer distance 540). Again, this capacitance created by placing the first and second dual-arm spiral antennas 510 and 520 close together within the composite laminate 502 is added to the parasitic capacitance between the conductive arms of the conformal integrated broadband stacked multi-spiral antenna system 500 in a way that changes the reactance of the system and tunes and matches the input impedance of the conformal integrated broadband stacked multi-spiral antenna system 500 looking into an input node (not shown in FIG. 5 but similar to 248 shown in FIG. 2) of the conformal integrated broadband stacked multi-spiral antenna system 500 to the characteristic impedance of the input transmission line(s) that is connected to the conformal integrated broadband stacked multi-spiral antenna system 500.

The conformal integrated broadband stacked multi-spiral antenna assembly 500 may be any form of a load-bearing or a non-load-bearing composite structural element, such as, for example, a composite cover, door, or access panel that may be attached to a mobile platform (such as a rotary-wing or fixed-wing aircraft. At the center of conformal integrated broadband stacked multi-spiral antenna assembly 500 is a via 550, through which transmission lines (not shown) such as, for example, coaxial cables may be fed and electrically connected to the arms of the dual-arm spiral antennas 510 and 520 at their centers so as to provide a center feed to each dual-arm spiral antenna 510 and 520 in the conformal integrated broadband stacked multi-spiral antenna array assembly 500. The coaxial cables may then be electrically connected to radios and transceivers of the mobile platform.

Figure 6A:
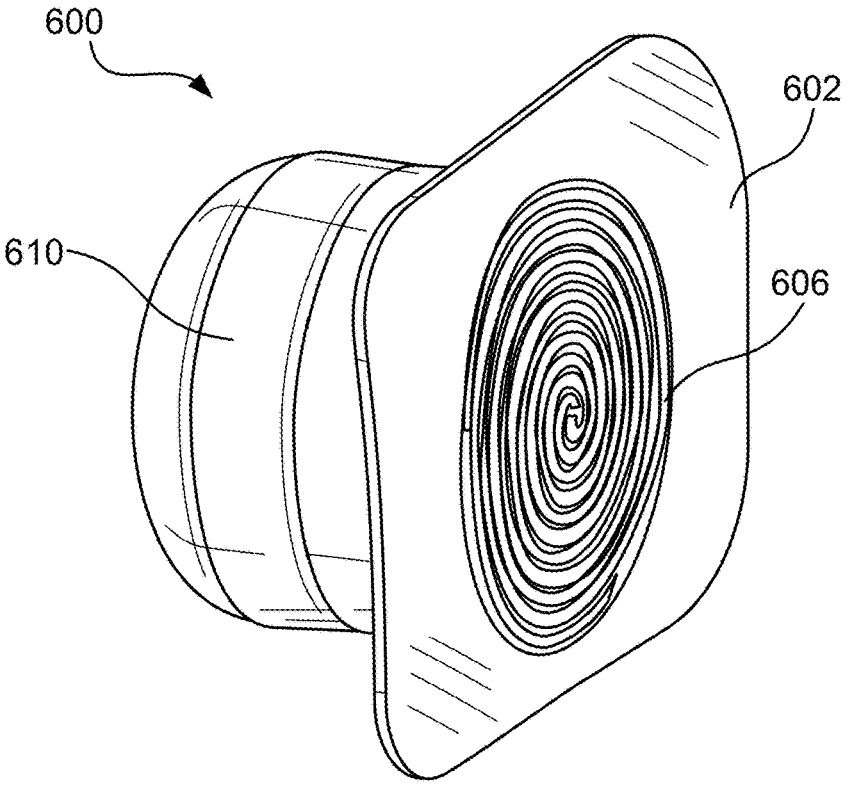
FIG. 6A is front perspective view of yet another example of an implementation of a broadband stacked dual-spiral antenna array in accordance with the present disclosure together with a reflecting cavity.

FIG. 6A is front perspective view of a broadband stacked dual-arm spiral antenna array 600 in accordance with the present disclosure together with a reflecting cavity. In FIG. 6A, a broadband stacked dual-arm spiral antenna array in accordance with the present disclosure is shown, comprising a substrate 602 and the outer-most dual-arm spiral antenna 606. Positioned adjacent to the back of the innermost dual-arm spiral antenna (not shown) is a reflecting cavity 610. In this example, the substrate 602 includes the composite laminate 502 and may extend out physically farther than the physical circumference size of the composite laminate 502 that includes the dual-arm spiral antennas 510 and 520. In general, the reflecting cavity 610 may be a metal bowl, lined with aluminum foil or other reflective materials. In other embodiments, the reflecting cavity 610 may contain high dielectric or ferrite materials as a backing to reduce its size.

Figure 6B:
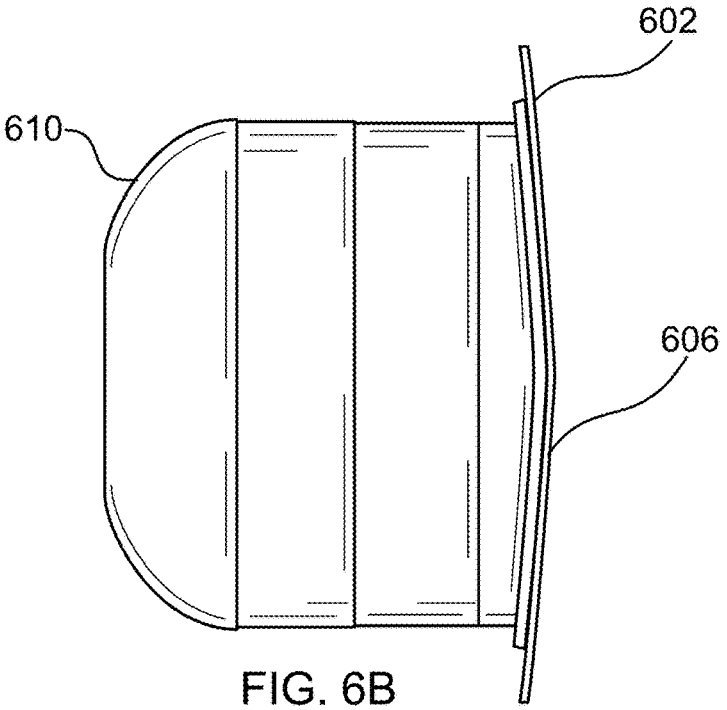
FIG. 6B is side elevation view of the broadband stacked dual-spiral antenna array with a reflecting cavity shown in FIG. 6A.

FIG. 6B is side elevation view of the broadband stacked dual-arm spiral antenna array with a reflecting cavity 610 shown in FIG. 6A, which is attached to the side adjacent to (bottom of) substrate 602, which corresponds to the inner-surface 565 of the composite laminate 502 in FIG. 5. The reflecting cavity 610 has a depth 612. The diameter of the reflecting cavity 610 should be large enough to cover the circumference of the inner-most dual-arm spiral antenna (not shown but corresponding to the physical size of the composite laminate 502). In this example, the depth is approximately equal to one-fourth of λco. Generally, the depth 612 of the reflecting cavity 610 should not be less than one-fourth of the λco for a reflecting cavity 610 that utilizes or is constructed of reflective materials, although the depth 612 of the reflecting cavity 610 may be less if a high dielectric or ferrite material is used as a backing within the reflecting cavity 610.

Figure 7:
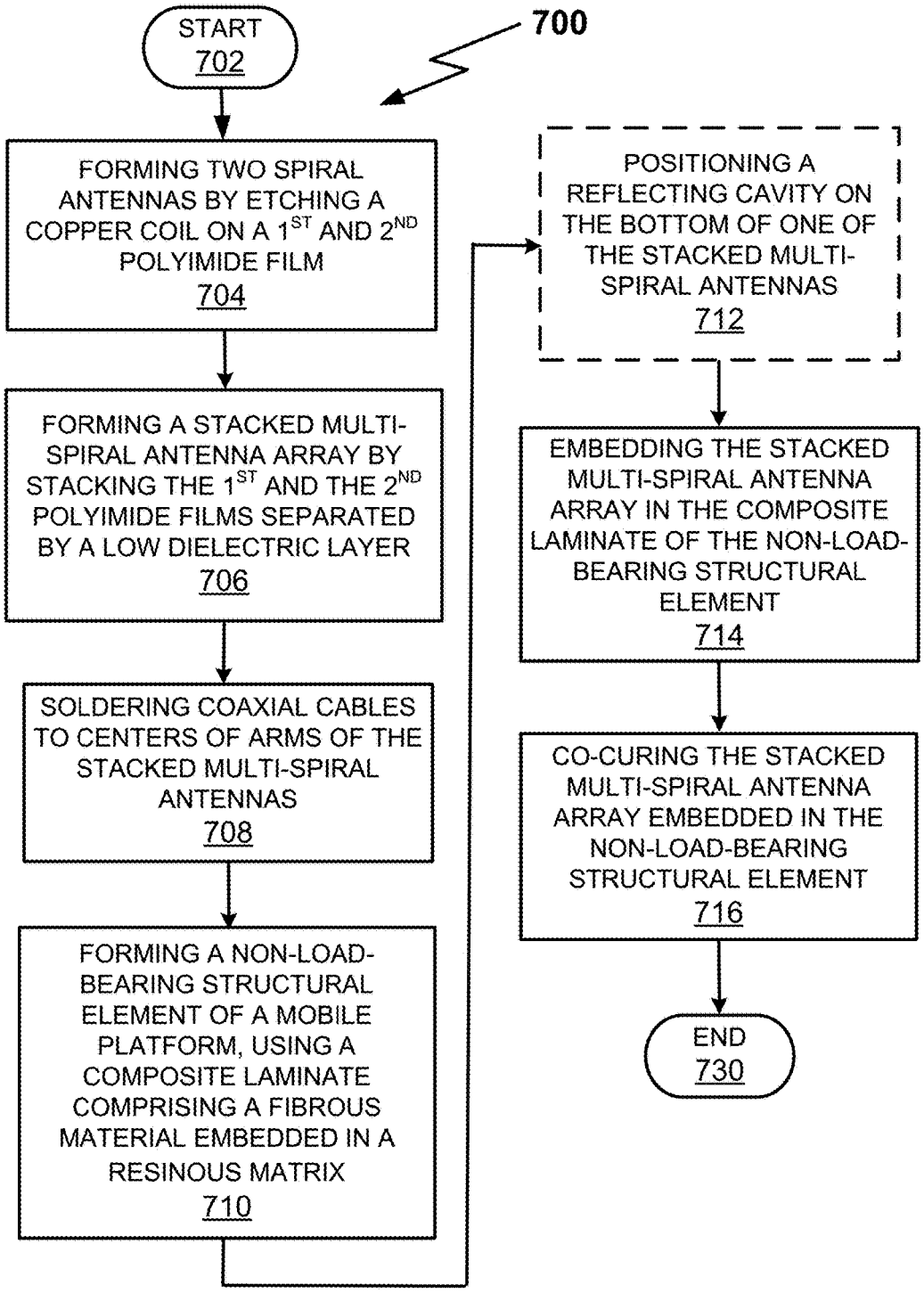
FIG. 7 is a flow diagram of one particular illustrative example of a method of forming a conformal integrated broadband stacked multi-spiral antenna system in accordance with the present disclosure.

Turning to FIG. 7, a flow diagram of one particular illustrative example of a method 700 of forming a conformal integrated broadband stacked multi-spiral antenna system in accordance with the present disclosure is shown. The method 700 starts in step 702, and in step 704, two dual-arm spiral antennas are formed by etching a copper coil onto a substrate, which substrate may be, for example, a 1 mil DuPont™ Kapton® polyimide film, thus forming a flexible dual-arm spiral antenna. In some applications, other materials may be used, including low dielectric polyesters such as polyethylene terephthalate (PET) or polyethylene terephthalate (PEN) film, or other low dielectric films having suitable thermal conductivity, heat stabilization, tensile strength, and flame-resistant properties while being capable of use as described herein. Examples of such films include Tetoron® and Melinex® PET, Teonex® PEN, and Mylar® PET.

In step 706, a broadband stacked multi-spiral antenna array is formed by stacking the two spiral antennas separated by a low dielectric layer with a generally uniform thickness, and in step 708, a pair of coaxial cables are soldered to the ends of the arms at the center of one of the dual-arm spiral antennas, where this pair of coaxial cables is used to connect the stacked multi-spiral antenna array to a radio or transceiver of a mobile platform in which the broadband stacked dual-arm dual-spiral antenna array will be used. Another pair of coaxial cables is soldered to the ends of the arms at the center of each of the spiral antennas to complete their electrical connection.

In step 710, a non-load bearing composite structural element of a mobile platform, such as a composite cover, door, or access panel for attachment to the mobile platform (e.g., an avionics or stowage bay access door), may be constructed using a composite laminate. An example of a composite laminate is a fibrous material embedded in a resinous matrix. Examples of the fibrous material include fiberglass, KEVLAR®, carbon fiber, and a carbon KEVLAR® hybrid fabric, all of which may be used with any of an epoxy resin, a vinyl ester, or a polyester resin. Other examples of composite laminates are non-conductive face sheets and a honeycomb core sandwich, and a structural foam, such as ROHACELL® structural foam, or other like electrically non-conductive but thermally conductive materials. ROHACELL® is available from Evonik Industries of Essen, Germany.

The next step in method 700 is optional step 712, wherein a reflecting cavity may be attached to the back of one of the spiral antennas of the stacked multi-spiral antenna array to improve the directionality of the multi-spiral antenna array. This step may be performed at any time prior to step 714, where the stacked multi-spiral antenna array is embedded in the composite laminate of the non-load bearing composite structural element formed in step 710. The final step of method 700, step 716, is co-curing the broadband stacked multi-spiral antenna array comprising the two polyimide dual-arm spiral antennas separated by a low dielectric layer and the non-load-bearing structural element formed in step 710. In lieu of steps 706-710, 714, and 716, another example of a method of forming a conformal integrated broadband dual-arm spiral antenna system in accordance with the present disclosure may entail bonding two spiral antennas separated by a low dielectric layer, soldering coaxial cables to centers of the spiral antennas using vias and solder, and then embedding the spiral antennas and the low dielectric in layers of a fiberglass laminate. The resulting laminate may then be applied as an appliqué to a face of the structural element or bonded to the face and then covered with a con-conductive protective coating. The process then ends at step 730.

It will be understood that various aspects or details may be changed. It is not exhaustive and does not limit the claims to the precise form disclosed. Furthermore, the foregoing description is for the purpose of illustration only, and not for the purpose of limitation. Modifications and variations are possible in light of the above description.

What is claimed is:

1. A broadband stacked multi-spiral antenna array comprising:

two or more stacked spiral antennas including:

a first multi-arm spiral antenna, a second multi-arm spiral antenna, an insulating layer positioned between the first multi-arm spiral antenna and the second multi-arm spiral antenna; and a common antenna feed coupled to each of the two or more stacked spiral antennas and configured to center-feed each of the two or more stacked spiral antennas in-phase.

2. The broadband stacked multi-spiral antenna array of claim 1, wherein the two or more stacked spiral antennas are:

two or more multi-arm Archimedean spiral antennas, two or more multi-arm equiangular spiral antennas, two or more multi-arm sinuous spiral antennas, or two or more multi-arm slotted spiral antennas.

3. The broadband stacked multi-spiral antenna array of claim 2, wherein the insulating layer includes air, a vacuum, or a non-conductive low dielectric laminate, which separates the two or more stacked spiral antennas to provide capacitance between the two or more stacked spiral antennas to tune an input impedance of the broadband stacked multi-spiral antenna array.

4. The broadband stacked multi-spiral antenna array of claim 3, further including a composite laminate including:

the first multi-arm spiral antenna, the second multi-arm spiral antenna, the insulating layer, an inner-surface, and a reflecting cavity positioned at a side adjacent to the inner-surface, wherein a depth of the reflecting cavity is greater than or equal to one-fourth of a wavelength of a center-operating frequency of the broadband stacked multi-spiral antenna array.

5. The broadband stacked multi-spiral antenna array of claim 4, wherein the insulating layer has a uniform thickness of less than or equal to ten percent of the wavelength of the center-operating frequency of the broadband stacked multi-spiral antenna array.

6. The broadband stacked multi-spiral antenna array of claim 1, wherein the two or more stacked spiral antennas include seven stacked spiral antennas, wherein a respective insulating layer having a generally uniform thickness is positioned between each pair of adjacent stacked spiral antennas of the seven stacked spiral antennas, and wherein the seven stacked spiral antennas are stacked in size order from a largest outer diameter stacked spiral antenna to a smallest outer diameter stacked spiral antenna.

7. The broadband stacked multi-spiral antenna array of claim 1, wherein the first multi-arm spiral antenna has a first arm width and a first arm spacing, and the second multi-arm spiral antenna has a second arm width and a second arm spacing, the first arm width equal to the second arm width and the first arm spacing equal to the second arm spacing.

8. A broadband stacked multi-spiral antenna assembly for use in a mobile platform, the broadband stacked multi-spiral antenna assembly comprising:

two or more stacked spiral antennas including:

a first multi-arm spiral antenna, a second multi-arm spiral antenna, an insulating layer positioned between the first multi-arm spiral antenna and the second multi-arm spiral antenna, a common antenna feed coupled to each of the two or more stacked spiral antennas and configured to center-feed each of the two or more stacked spiral antennas in-phase; and a composite laminate in which the first multi-arm spiral antenna, and the second multi-arm spiral antenna are embedded.

9. The broadband stacked multi-spiral antenna assembly of claim 8, wherein each of the first and the second multi-arm spiral antennas includes two or more arms, and wherein the two or more stacked spiral antennas are:

two or more Archimedean spiral antennas, two or more equiangular spiral antennas, two or more sinuous spiral antennas, or two or more slotted spiral antennas, and wherein each of the two or more stacked spiral antennas has:

a number of turns that are the same, an arm width that is the same, and a spacing between the arms that is the same.

10. The broadband stacked multi-spiral antenna assembly of claim 9, wherein the composite laminate includes at least one of a fibrous material embedded in a resinous matrix, a honeycomb core sandwich, or a structural foam.

11. The broadband stacked multi-spiral antenna assembly of claim 10, wherein the fibrous material is fiberglass, KEVLAR®, carbon fiber, or a carbon KEVLAR® hybrid fabric, and wherein the resinous matrix is an epoxy resin, a vinyl ester resin, or a polyester resin.

12. The broadband stacked multi-spiral antenna assembly of claim 9, further comprising a reflecting cavity positioned adjacent to a particular spiral antenna of the two or more stacked spiral antennas.

13. The broadband stacked multi-spiral antenna assembly of claim 9, wherein the composite laminate comprises a via that provides a pathway for the common antenna feed.

14. The broadband stacked multi-spiral antenna assembly of claim 9, wherein the composite laminate is a portion of a structural element of an aircraft.

15. The broadband stacked multi-spiral antenna assembly of claim 14, where the structural element is selected from a group consisting of a stowage bay access door, a hatch cover, and an access panel of an aircraft.

16. The broadband stacked multi-spiral antenna assembly of claim 14, where the structural element is selected from a group consisting of a fuselage, a wing, and an empennage of an aircraft.

17. A method of forming a broadband stacked multi-spiral antenna assembly, the method comprising:

embedding a stacked multi-spiral antenna array in a structural element of a mobile platform, the stacked multi-spiral antenna array comprising two or more stacked multi-arm spiral antennas with each pair of adjacent multi-arm spiral antennas of the two or more stacked multi-arm spiral antennas separated by an insulating layer, and coupling each of the two or more stacked multi-arm spiral antennas to a common antenna feed to center-feed each of the two or more stacked multi-arm spiral antennas in-phase.

18. The method of forming a broadband stacked multi-spiral antenna assembly of claim 17, wherein the structural element includes a composite laminate includes at least one of a fibrous material embedded in a resinous matrix, a honeycomb sandwich core with non-conductive face sheets, or a structural foam.

19. The method of forming a broadband stacked multi-spiral antenna assembly of claim 17, wherein the step of embedding the stacked multi-spiral antenna array in the structural element includes co-curing a material of the stacked multi-spiral antenna array and a material of the structural element.

20. The method of forming a broadband stacked multi-spiral antenna assembly of claim 17, further comprising forming the two or more stacked multi-arm spiral antennas by etching a metal layer that is on a polyimide film.

* * * * *